US007109873B2

(12) United States Patent
Giotto et al.

(10) Patent No.: US 7,109,873 B2
(45) Date of Patent: Sep. 19, 2006

(54) FIBER OPTIC CABLE SENSOR FOR MOVABLE OBJECTS

(76) Inventors: Frank Giotto, 3823 Mohawk St., New Hartford, NY (US) 13413; James Hisert, 4852 Day Rd., Vernon, NY (US) 13476; Raymond Joseph Wertz, 77 Clinton St., Apt. F-7, New York Mills, NY (US) 13417; Benjamin Lee Sitler, 111 Viburnum Ln, New Hartford, NY (US) 13413; Murray Joseph Selwyn Kirshtein, 118 Bleecker St., Utica, NY (US) 13501

( * ) Notice: Subject to any disclaimer, the term of this patent is extended or adjusted under 35 U.S.C. 154(b) by 62 days.

(21) Appl. No.: 10/956,570

(22) Filed: Oct. 4, 2004

(65) Prior Publication Data

US 2006/0071805 A1 Apr. 6, 2006

(51) Int. Cl.
*G08B 17/02* (2006.01)

(52) U.S. Cl. ..... 340/590; 340/635; 340/652; 340/500; 385/12; 385/13; 385/92; 385/100; 385/477

(58) Field of Classification Search ..... None
See application file for complete search history.

(56) References Cited

FOREIGN PATENT DOCUMENTS

JP 404076124 A * 3/1992

* cited by examiner

*Primary Examiner*—Julie Bichngoc Lieu

(57) ABSTRACT

There is provided an apparatus that determines the location of an impermissible tamper on an object, such as an impermissible attempt to gain access to a manhole system or an attempt to steal a work of art, includes a housing disposed adjacently to the object. A fiber optic cable runs through the housing. The object includes a portion that cooperates with internal components of the housing to maintain the fiber optic cable in a non-attenuated state. Upon the impermissible tamper, that portion of the object no longer cooperates with the internal components of the housing. An elastic force internal to the housing cooperates with more internal housing components to create a microbend to the fiber optic cable. Using known optical time domain reflectometer technology, the location of the microbend along the fiber optic cable is readily discerned.

23 Claims, 10 Drawing Sheets

FIBER OPTIC CABLE SENSOR FOR MOVABLE OBJECTS

FIELD OF THE INVENTION

The present invention relates generally to the field of electronic intrusion sensors and, more particularly, to a fiber optic cable based sensor system that locates an impermissible movement of an object to help prevent theft or terrorism.

BACKGROUND OF THE INVENTION

There are many sensor systems that indicate the location of an intrusion attempt into a secure location or an attempt to steal a secure asset. For example, a door leading to a secure area might be rigged with a tamper switch that automatically relays a signal to a multiplexer and then onward to a de-multiplexer where the location of the intrusion is determined.

There are presently no interior intrusion detection systems that work for spark sensitive rooms such as those at oil refineries and others at power plants. The known systems for these applications include an electronic signal that can ignite the contents of the room, and thus cause an explosion.

Other types of systems include microwave sensors where a microwave transmitter and receiver are aligned and the intrusion attempt causes a break in the reception thereby triggering an alarm. Once again this type of system will not work inside of a spark sensitive room for the aforementioned reasons. These systems are bulky, expensive and highly noticeable.

These system also are tedious for many applications because much cabling is required to transmit signals indicative of an intrusion attempt. For instance, where a manhole system is desired to be protected from intrusion, (such as by terrorists) it would be necessary to install a great deal of cabling throughout the underground system. Further, this cabling is easily corrupted making the entire system suspect to tamper.

If wireless links were to be used, the reliability of the system is constantly in jeopardy because of the inherent unreliable nature of the wireless technology. An illustration of this is the common occurrence that interference from external sources causes disruption to wireless communications. It is noticeable that these antennas sometimes become unreliable during storms. Additionally, much expensive equipment and installation is required for wireless communications.

A manhole system typically carries underground utilities of which can include water drainage, water intake pipes, electrical systems, etc. A manhole cover provides access to such manhole systems for the purpose of repairs and maintenance.

It is a reasonable assumption that terrorists would like to gain access to underground utility systems because of the mass amount of urban destruction that can be attained in compromising such structures. In some cases, manhole covers are welded to their frames in anticipation of a large public event. Entrances may also be monitored by visual surveillance equipment. Each of these methods are costly and laborious.

Thieves often target works of art and other valuable items. There are certain electronic security systems for the protection of works of art, some of which include microwave transmitters and receivers. The microwave systems operate by sending a signal from a transmitter to a receiver. When the signal is interrupted, the system indicates an intrusion attempt.

These systems are expensive and suspect to tampering.

OBJECTS AND SUMMARY OF THE PRESENT INVENTION

It is an object of the present invention to improve the field of security systems.

It is another object of the present invention to improve local, national and international security.

It is a further object of the present invention to provide an intrusion detection system that indicates when and where an intrusion is made on an underground utility system.

It is yet another object of the present invention to provide an intrusion detection system that indicates when and where a valuable item has been impermissibly moved.

It is still a further object of the present invention to provide an intrusion detection system that indicates when and where an intrusion attempt is made on spark sensitive room.

It is still yet another object of the present invention to tamper proof electronic intrusion detection system.

These and other and further objects are provided in accordance with the present invention in which an apparatus that determines the location of an impermissible tamper on an object, such as an impermissible attempt to gain access to a manhole system or an attempt to steal a work of art, includes a housing disposed adjacently to the object. A fiber optic cable runs through the housing. The object includes a portion that cooperates with internal components of the housing to maintain the fiber optic cable in a non-attenuated state.

Upon the impermissible tamper, that portion of the object no longer cooperates with the internal components of the housing. An elastic force internal to the housing cooperates with more internal housing components to create a microbend to the fiber optic cable.

Using known means, the location of the microbend along the fiber optic cable is readily discerned.

BRIEF DESCRIPTION OF THE DRAWINGS

The above and other objects of the present invention will be better understood by reading the following detailed description of the preferred embodiments of the invention, when considered in conjunction with the accompanying drawings, in which.

DETAILED DESCRIPTION OF THE PRESENT INVENTION

Figure 1:
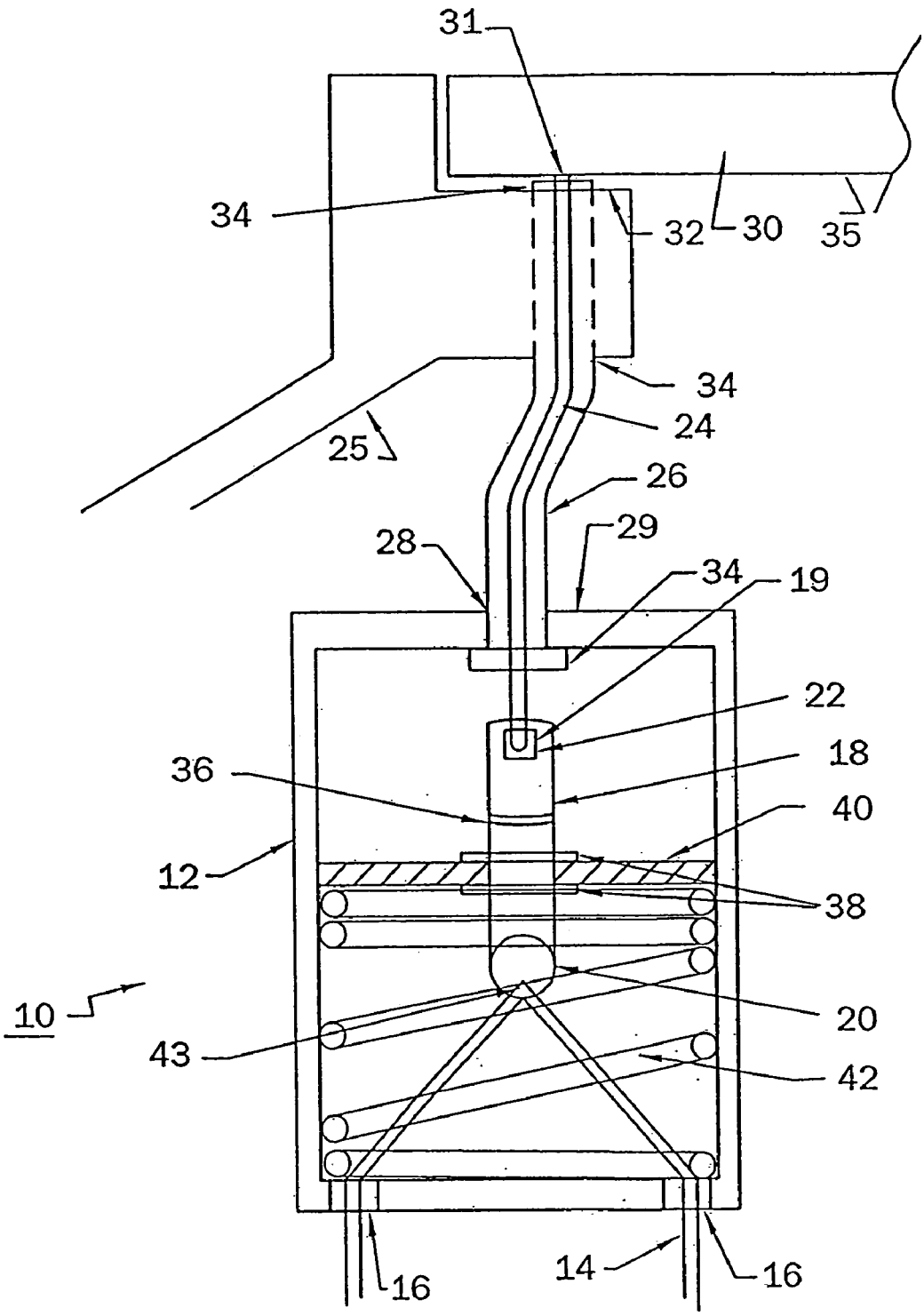
FIG. 1 is a side elevation view of a preferred embodiment of the present invention in use in an underground utility system.
Figure 2:
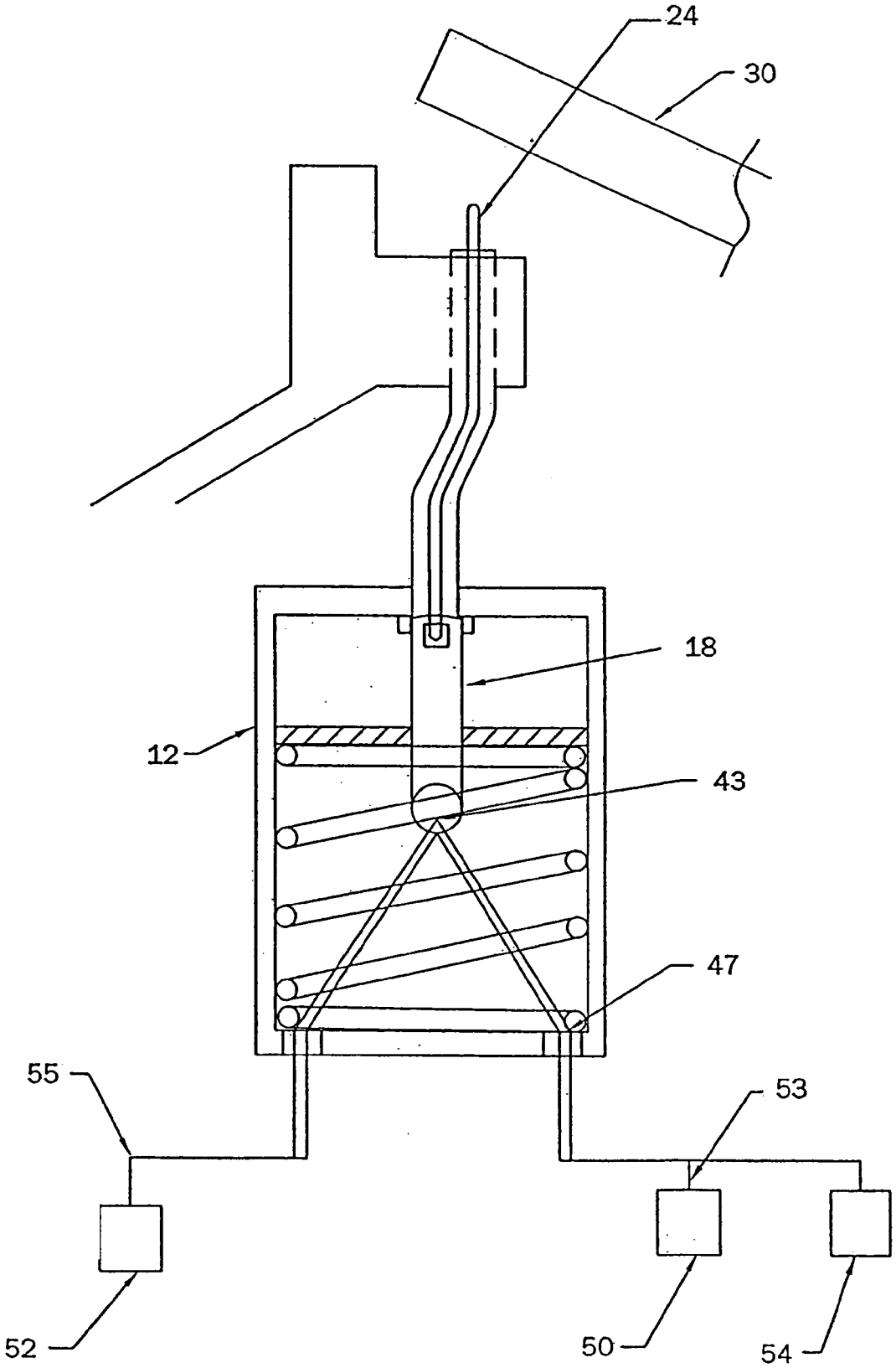
FIG. 2 is a side elevation view of the embodiment of FIG. 1 in a tamper state.

Referring now to FIGS. 1 and 2, a fiber optic cable sensor 10 in accordance with a preferred embodiment of the present invention includes a cable housing 12 mounted adjacent to an interior manhole wall 25. A fiber optic cable 14 runs through a pair of openings 16 disposed through the cable housing 12. For an entire manhole system it is desirable to install a cable housing 12 of the present invention adjacent to each individual manhole cover 30 and run a single fiber optic cable 14 through each individual cable housing 12. Thus, each manhole cover 30 of the system would be pre-assigned a specific location or length along the fiber optic cable 14, the reasons of which will become apparent with further reading.

A push/pull cable 24 extends through an opening 28 located at the top 29 of the cable housing 12 and contacts a bottom surface 31 of the manhole cover 30 which rests on an annular rim 32. In the embodiment shown in FIGS. 1 and 2, the push/pull cable 24 is routed within a conduit 26 which runs through an opening 34 in the annular rim 32. Alternatively, the conduit 26 may run to the inside of the annular rim 32 so that it is not necessary to install an opening 34 into an existing annular rim 32.

By routing the conduit 26 through the opening 34 in the annular rim 32, the conduit 26 becomes protected from unnecessary damage by those who seek access through the manhole, such as for maintenance.

Turning back to the cable housing 12, the fiber optic cable 14 is threaded through an opening 20 in a rigid linkage 18 disposed within the cable housing 12. At an opposite end of the rigid linkage 18, the push/pull cable 24 is attached through a second opening 19 within the rigid linkage. It should become readily apparent that other attaching methods may also be used to connect the push/pull cable 24 to the rigid linkage 18.

The rigid linkage 18 includes a threaded section 36 that allows fixed attachment to an elastic force compression cover 40 via a pair of locknuts 38. Thus the rigid linkage 18, the push/pull cable 24 and the elastic force compression cover 40 are stationary with respect to each other or, in other words, move together.

The weight of the manhole cover 30 forces the push/pull cable 24, the rigid linkage 18 and the elastic force compression cover 40 together downwardly, thus compressing a spring 42 as shown in FIG. 1.

Referring now to FIG. 2, the manhole cover 30 is removed to gain access to the manhole system. The force of the spring 42 now forces the compression cover 40, the push/pull cable 24 and the rigid linkage 18 together upwardly. When the rigid linkage 18 moves upwardly, the angle at which the fiber optic cable 14 threads through the opening 20 in the rigid linkage 18 becomes significantly decreased, which is called a microbend 43 in the fiber optic cable 14.

To keep sure that a microbend 43 is created, it is sometimes necessary to secure, by epoxy 47, portions of the fiber optic cable 14 to the housing 12.

Still referring to FIG. 2, a light source 50 transmits a light pulse through the fiber optic cable 14 from a first cable end 53 to a second cable end 55 wherein the light intensity is measured by a photodetector 52. It should be noted that a number of fiber optic cable sensors 10 can be installed between the light source 50 and the photodetector 52.

When the measured light intensity falls below a predetermined threshold level, such as is caused by the microbend 43 in the fiber optic cable 14, an optical time domain reflectometer ("OTDR") 54 automatically triggers on.

Using known technology, the OTDR 54 locates the position of the microbend 43 along the fiber optic cable 14. OTDR technology determines an amount of backscattered light at each point along the fiber optic cable 14. A fiber optic cable 14 inherently contains an even distribution of impurities which forces a reflection of light back toward the light source. The OTDR 54 utilizes a second photodetector (not shown) that receives the backscattered light.

Since each fiber optic cable sensor 10 is assigned a predetermined distance, or length, along the fiber optic cable 14, it is now known which fiber optic cable sensor 10 contains the microbend 43. Thus it is known which manhole cover 30 has been removed.

Figure 3:
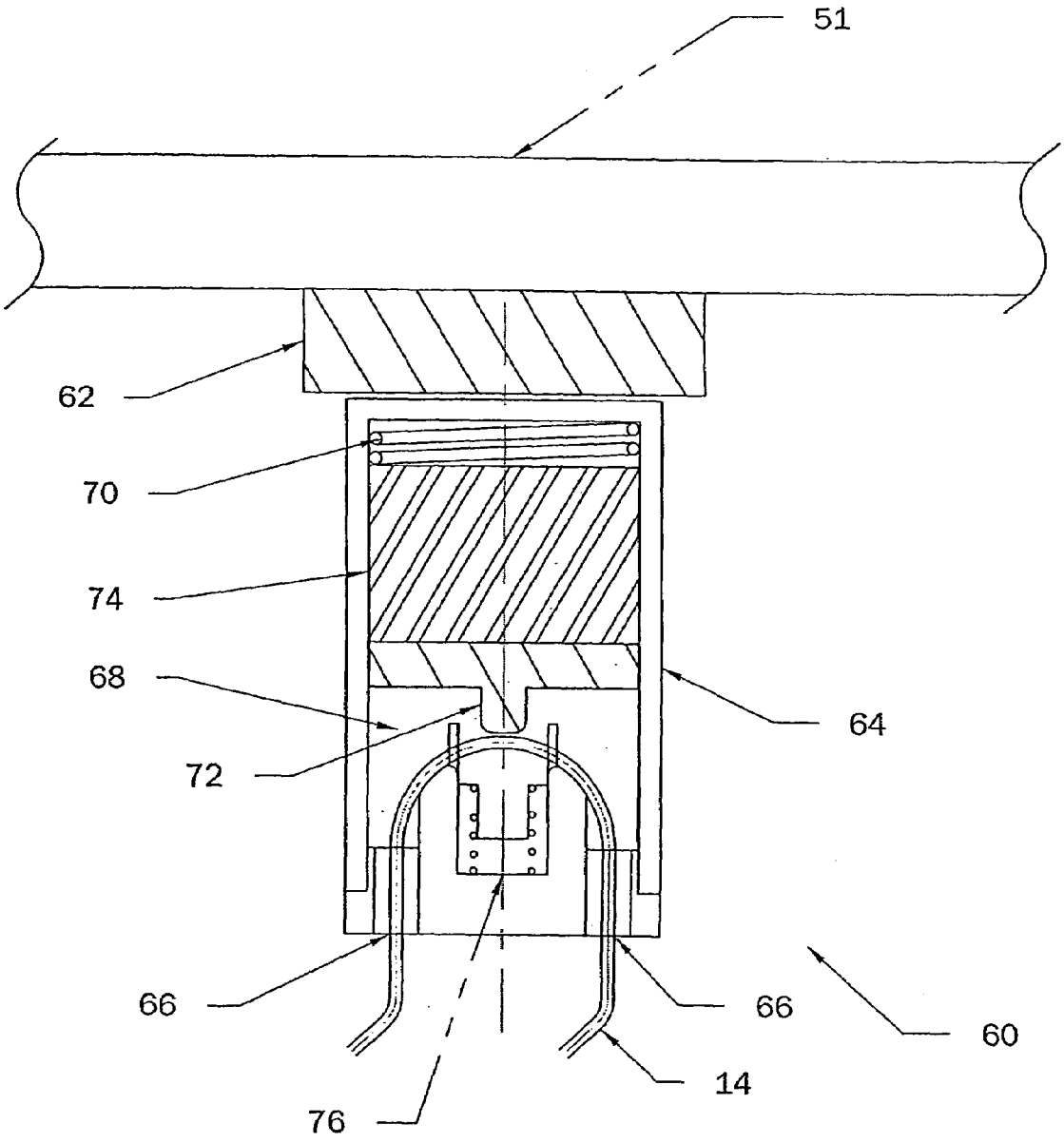
FIG. 3 is a side elevation view of an alternative embodiment of the present invention.

Turning now to FIG. 3, there is shown an alternative embodiment of a fiber optic cable sensor 60 the present invention. An access device 51, such as a door or a manhole cover, or even a work of art includes a magnetic portion 62. Alternatively, the access device 51 itself can be magnetically attractive.

A fiber optic cable housing 64 adjacently disposed to the magnetic portion 62 includes a fiber optic cable 14 running through a pair of housing openings 66. A spring loaded plunger 68 includes a spring 70, a plunger head 72 and a magnetic component 74.

Still referring to FIG. 3, magnetic component 74 and magnetic portion 62 are closely positioned to create a magnetic force which overcomes the elastic force provided by the spring 70, thus forcing the plunger 68 to an upward position.

Figure 4:
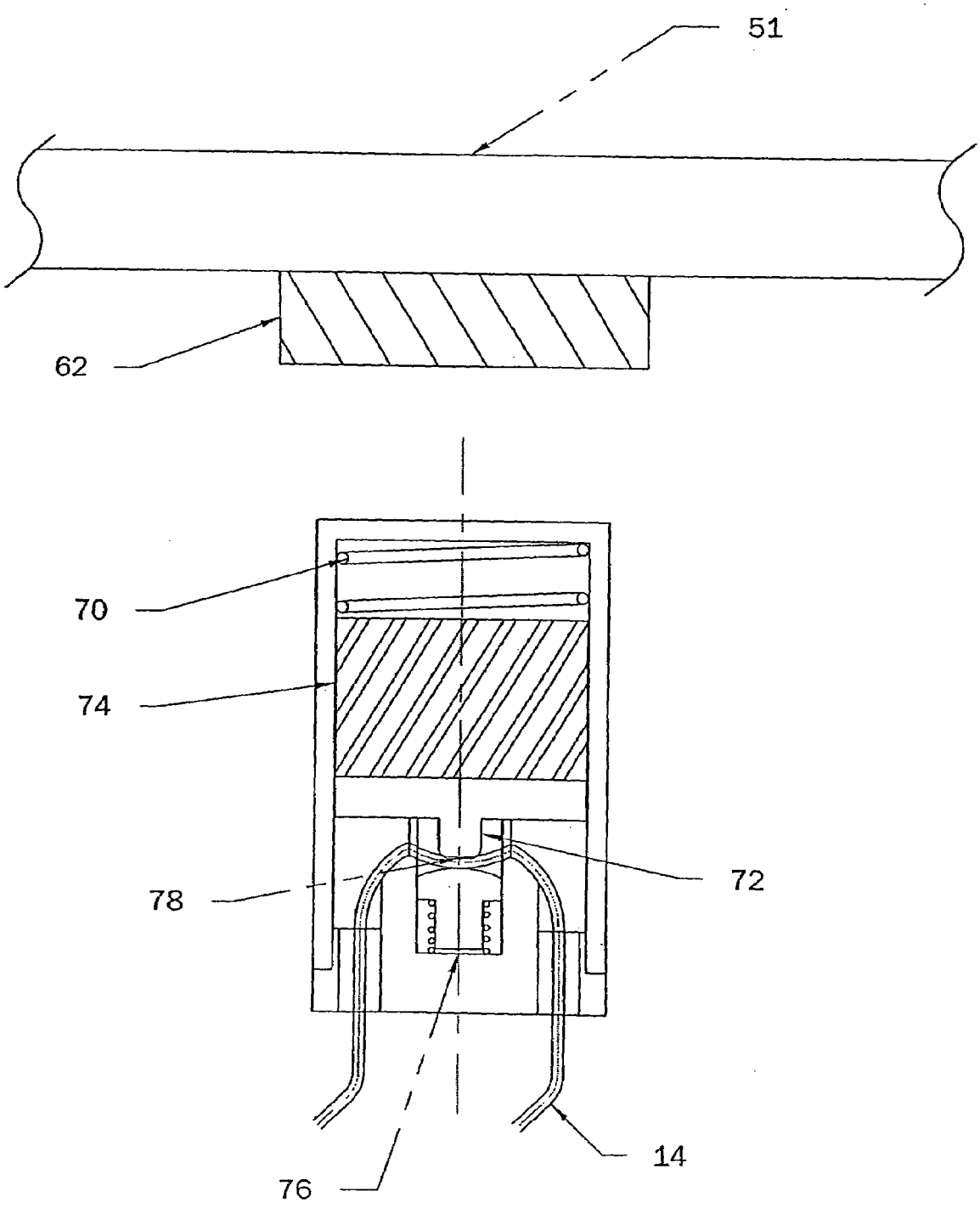
FIG. 4 is a side elevation view of the embodiment of FIG. 3 in a tamper state.

When the access device 51 is moved away from the housing, shown in FIG. 4, such as during a tamper or intrusion attempt, the magnetic force between the magnetic components dissipates. Thus, the elastic force of the spring 70 takes over, thereby forcing the plunger head 72 into an attenuation well 76, which causes a microbend 78 in the fiber optic cable, shown in FIG. 4. The location of the tamper of intrusion attempt is easily discerned using the method previously described herein.

Figure 5:
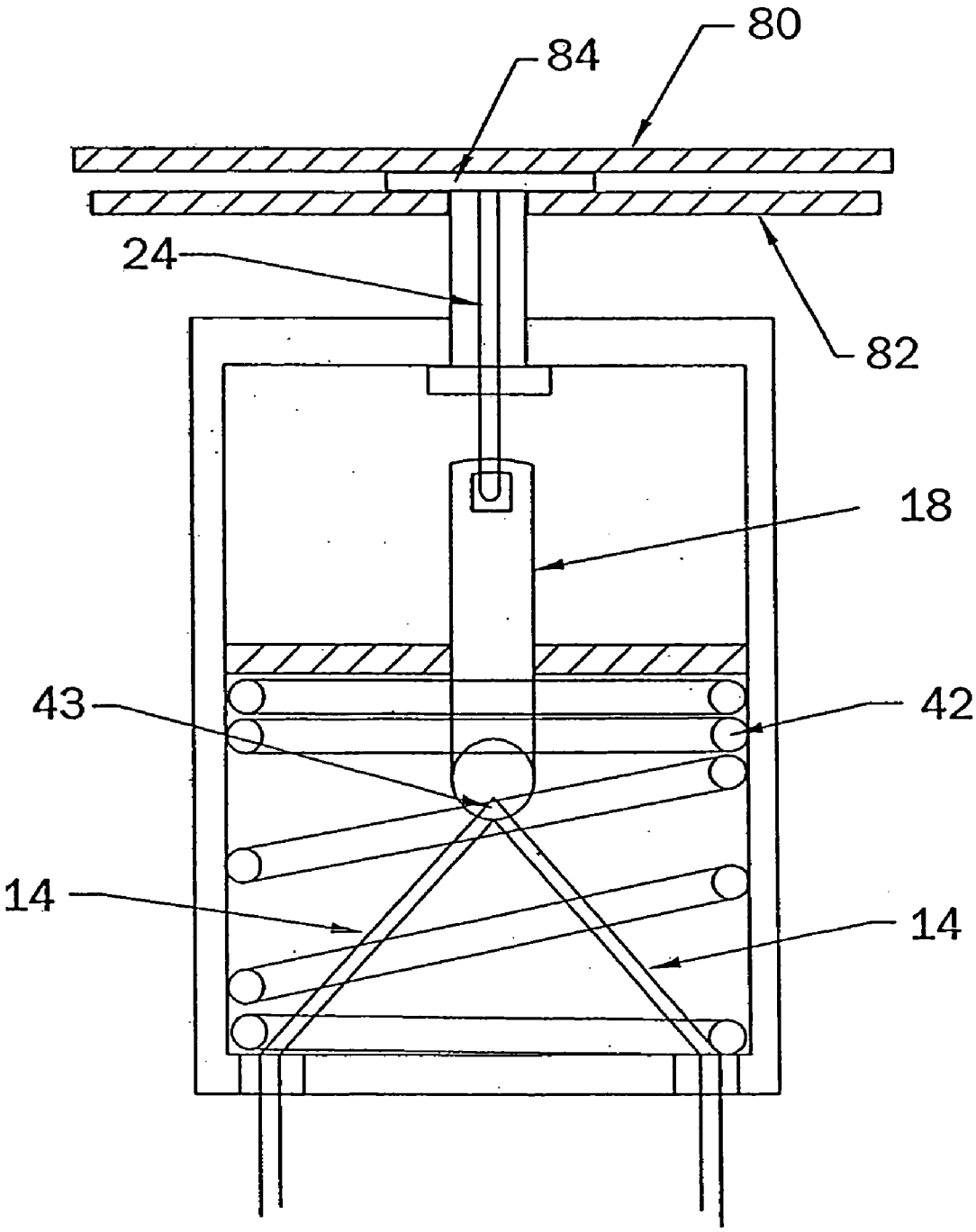
FIG. 5 is a side elevation view of the embodiment of FIG. 1 in use with a work of art.
Figure 6:
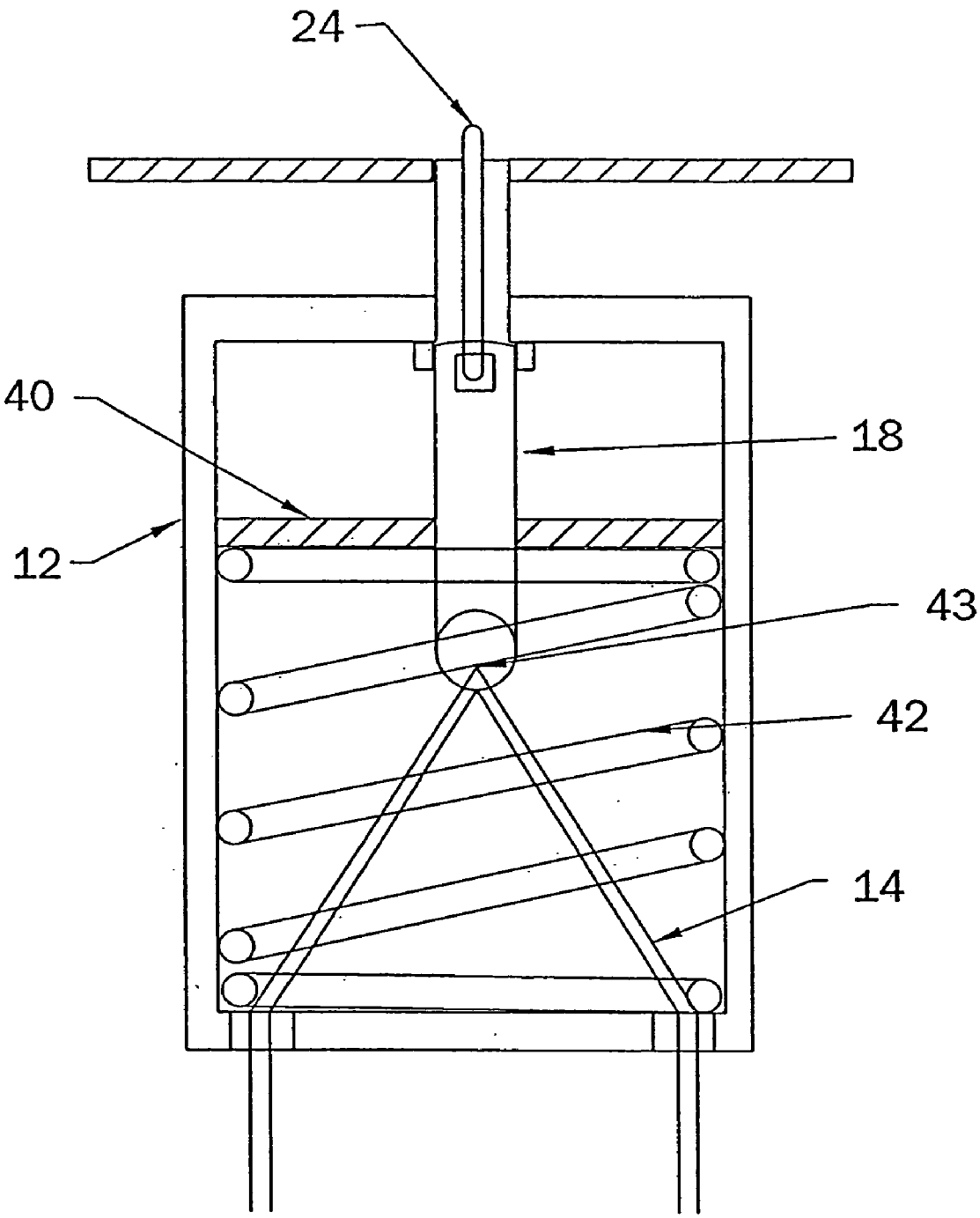
FIG. 6 is a side elevation view of the embodiment of FIG. 5 in a tamper state.

Referring now to FIGS. 5 and 6, there is shown how a work of art 80 or other valuable object is protected from theft in accordance with the present invention. The cable housing 12 having the push/pull cable 24 is disposed within or behind a wall 82 or other structure which supports the work of art 80. A protruding member 84 extends behind the work of art 80 and forces the push/pull cable 24 inward when the work of art 80 is displayed at its appropriate location. When the work of art 80 is removed or stolen the spring 42 pushes the protruding member 84 outward, thus forming the microbend 43 in the fiber optic cable in much the same fashion as described in the embodiment of FIGS. 1 and 2 herein.

As a result, an OTDR (not shown) functions as similarly described to indicate the location of the microbend 43 and, hence, also indicate which work of art 80 has been corrupted.

Figure 7:
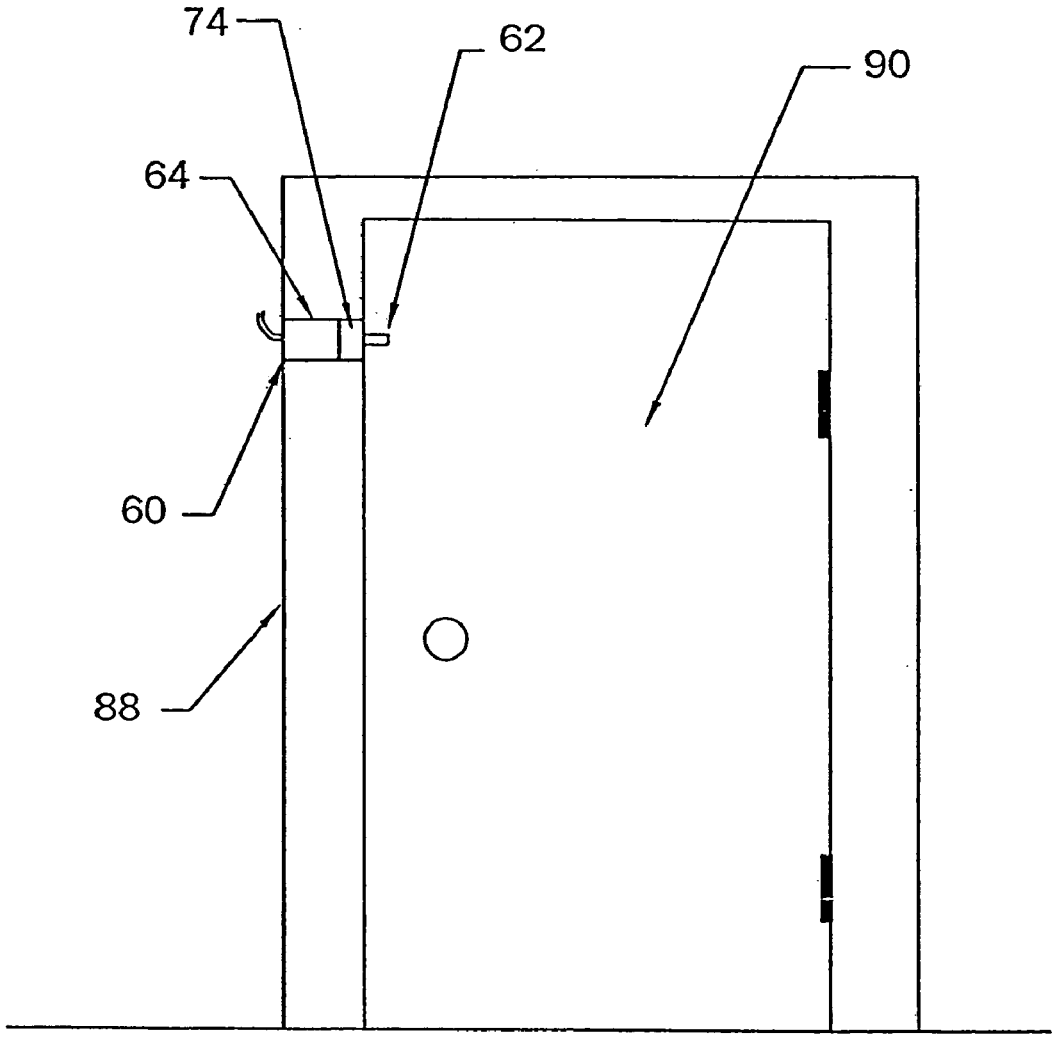
FIG. 7 is a front view of the embodiment of FIG. 3 in use in a spark sensitive room.
Figure 8:
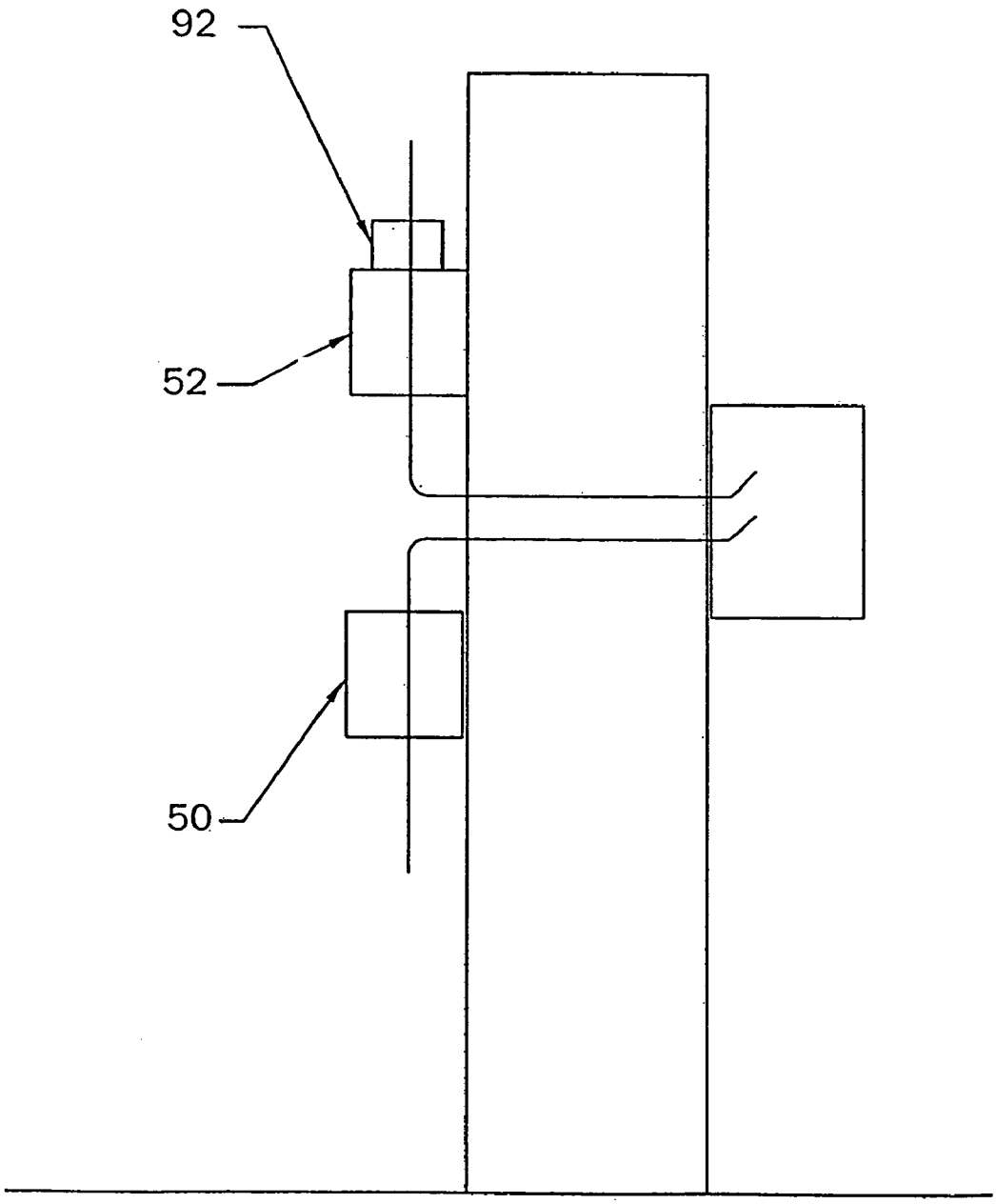
FIG. 8 is a side elevation view of the embodiment of FIG. 7 also depicting a light source, a light receiver and a relay.

Referring now to FIGS. 7 and 8, there is shown how an intrusion attempt into a spark sensitive room is monitored in accordance with the present invention. The fiber optic cable sensor 60, also depicted in FIGS. 3 and 4, includes the cable housing 64 mounted to a door jamb 88 or molding. A magnetic component 62 mounted to the door 90 mutually attracts the magnetic component 62 of the cable housing 64. A light source 50 transmits a light signal having a predetermined receivable intensity to a light detector 52.

When the door becomes opened the magnetic attraction disappears and the spring 70 forces the plunger head 72 into the attenuation well 76, as depicted in FIG. 4. Thus, the microbend 78 is created in the fiber optic cable 14, thereby dropping the receivable light intensity below a predetermined level. A relay 92 responsive to the reduction in received light intensity sends a signal that the door 90 to the spark sensitive room has been impermissibly tampered.

The above described systems will also work with an OTDR as the sole light transmitting and receiving sources. One feature of the above described systems is that assets and manhole systems can be monitored on a continuous basis from a remote location. An added benefit with using the above described system in a manhole structure is that very limited cable installation is necessary because fiber optic cabling presently exists in many manhole systems.

Each of the above described systems are tamper proof because it is impossible to cut a fiber optic cable without a detection of loss of light intensity at the receiving end. Thus, attempts to short wire the system automatically fail.

Figure 9:
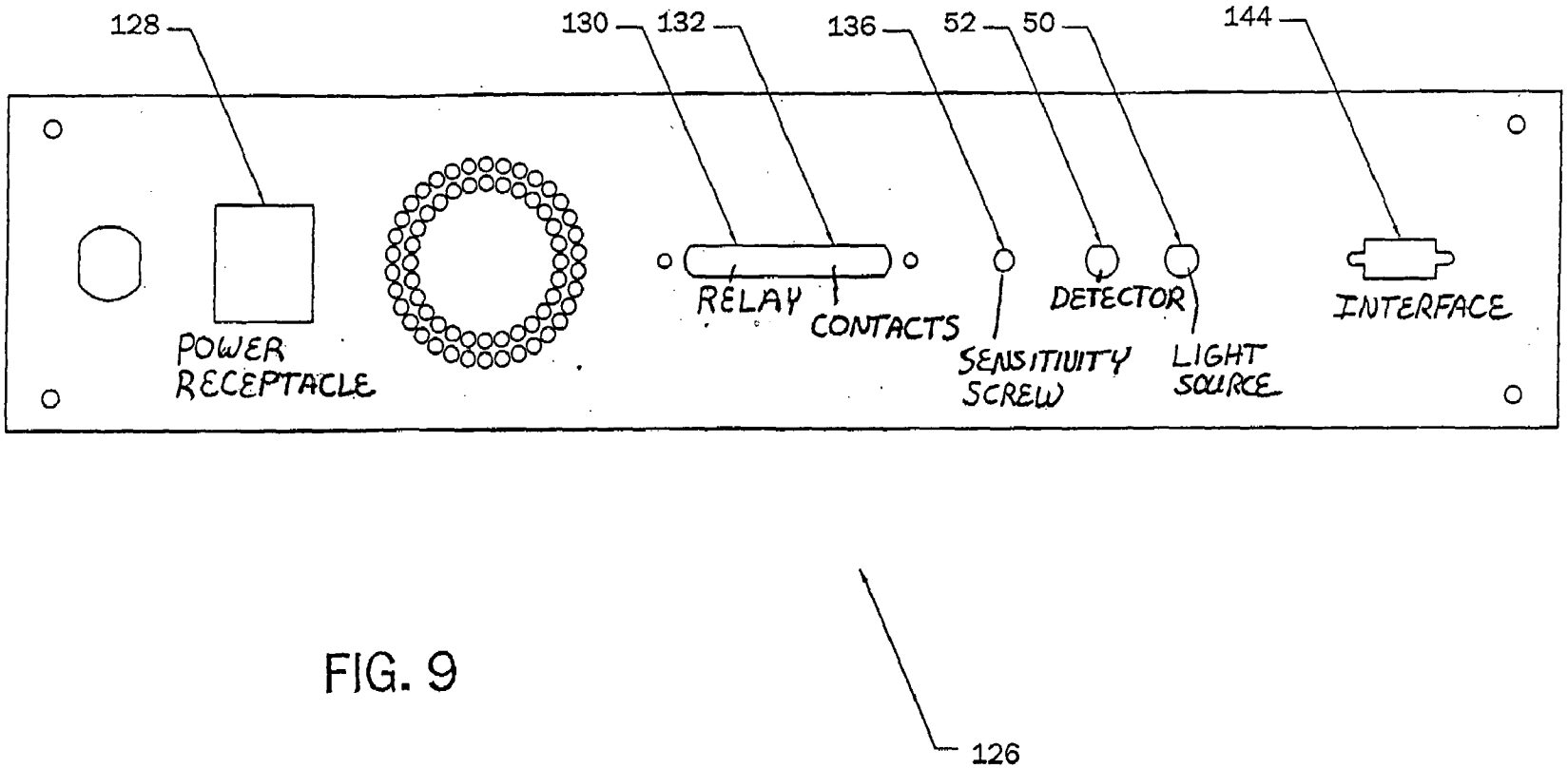
FIG. 9 shows a front side of a control unit which accommodates the preferred embodiments of the present invention.
Figure 10:
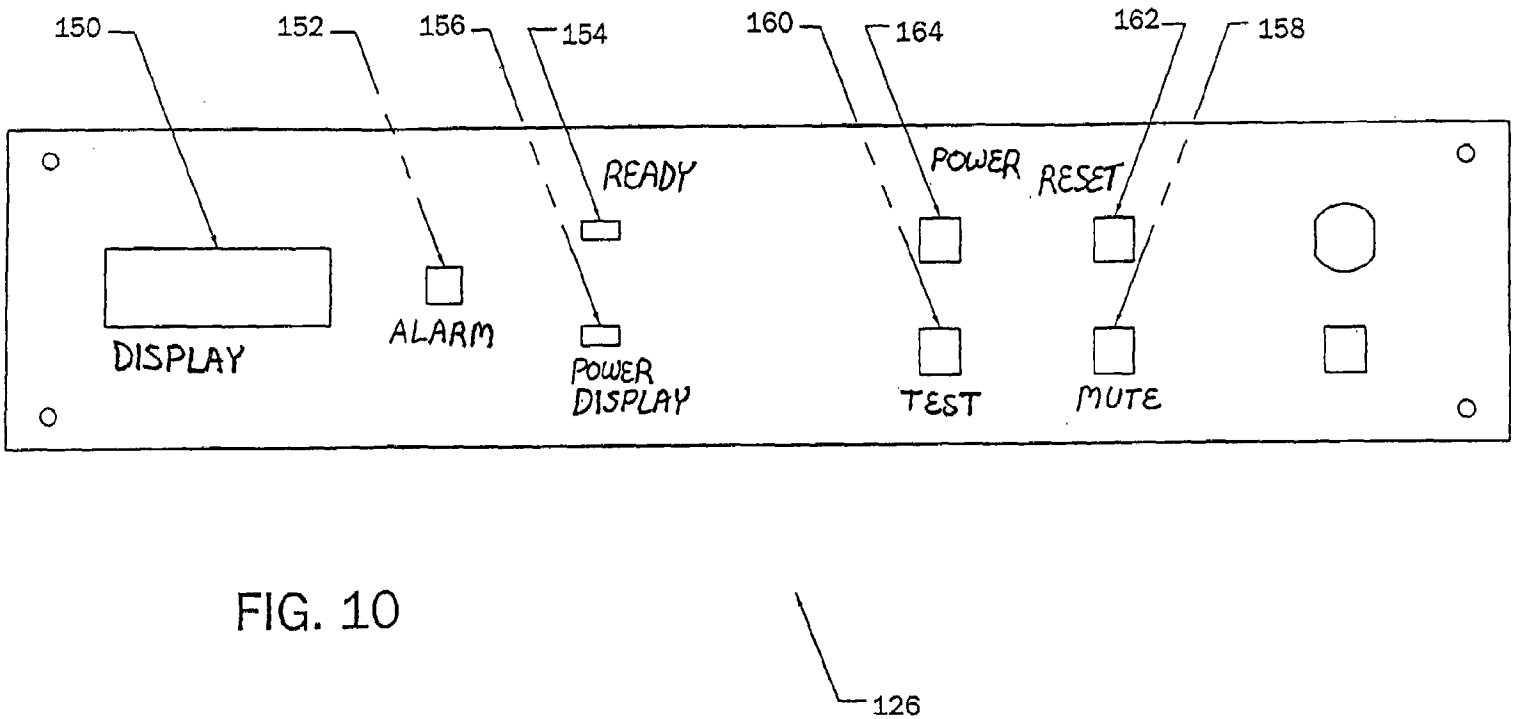
FIG. 10 shows back side of the control unit of FIG. 9.

Referring now to FIGS. 9 and 10, the intrusion detection sensitivity is adjusted by turning a sensitivity screw 136. In the embodiment depicted in FIG. 2, only the first end 53 of the fiber optic cable 14 is coupled to a light source port 140. The light source 50 emits a known quantity of light through the first end 53 of the fiber optic cable 14 and transmitted light is returned to the light detector 52. The sensitivity is adjusted by altering the required intensity of transmitted light detected at the second end 55 of the fiber optic cable 14 to produce a positive intrusion detection.

For the embodiment depicted in FIGS. 1–6, the cable is looped back to the control panel 126 so that light can be detected at the second end 55 as well as through backscattering means at the first end 53 of the fiber optic cable 14. The sensitivity is adjusted by altering the level of received light that is required to produce a positive intrusion detection.

Cable data is continuously transmitted to a computer through a RS-232 serial port and interface 144. Computer software programs receive and manipulate this cable data. The computer allows a system operator to monitor the fiber optic cable 14 from a remote location.

A front panel 148 of the control panel 126 includes an LCD display 150, which displays the length of fiber optic cable 14 through which the emitted light has passed. In a typical example, the light source 50 emits a light pulse and then the detector 52 or OTDR 54 receives backscattered light at varying increments in time. The LCD display 150 shows the cable lengths at these small increments in time. Alternatively, the detector 52 receives the transmitted light at the second end 55 of the fiber optic cable 14.

When an attenuation of the light signal is detected, the OTDR 54 searches for the location of the microbend 43 and the display locks onto the length at the intrusion or microbend location.

Looking at FIG. 9, a back side 124 of the control panel 126 includes a standard 110 volt single phase power receptacle 128. One relay pair 130 controls three pairs of contacts 132 to control external system devices, such as, perimeter lights and phone alarms (not shown). For example, the first two contact pairs are open, thereby having the perimeter lights in an OFF state. When an intrusion is detected the relay pair 130 causes the contacts to close, thereby putting the perimeter lights or other alarm to an ON state.

Where no intrusion is detected, the control panel 126 continues such incremental testing until the length of the perimeter is reached. It should be noted that the units can be cascaded to provide an indefinite cable length. Further, a multiplicity of cables can be installed to one control panel 126 wherein an optical switcher (Not shown) disposed in the control panel 126 allows for the monitoring of the light signal through the multiple cables.

An alarm LED 152 becomes illuminated when an intrusion is detected. A system ready LED 154 lets the user know that the control panel 126 has begun operation. A power display 156 illuminates when electric power is provided to the unit.

A mute switch 158 provides the ability to mute an alarm. A system test switch 160 provides the ability to simulate a break for purposes of testing how the control panel 126 responds to an intrusion.

A reset 162 functions in either the ENABLED state or DISABLED state. When the reset 162 is ENABLED, an alarm will cease when the intrusion detection condition is no longer detectable. In DISABLED state, the alarm continues upon an intrusion detection condition until the alarm is keyed to stop. Finally, a power switch 164 turns the unit on and off.

Various changes and modifications, other than those described above in the preferred embodiment of the invention described herein will be apparent to those skilled in the art. While the invention has been described with respect to certain preferred embodiments and exemplifications, it is not intended to limit the scope of the invention thereby, but solely by the claims appended hereto.

What is claimed is:

1. An apparatus that determines the location of an intrusion attempt on an underground utility system, wherein said underground utility system includes at least one access means, said apparatus comprising:

a housing adjacently disposed to said at least one access means;

at least one fiber optic cable disposed through said housing;

an elastic force which cooperates with a bending means for creating a microbend to said fiber optic cable;

an interactive force which overcomes said elastic force in a non-tamper state, said interactive force cooperating with said bending means for keeping said fiber optic cable in an unbended state, wherein said interactive force dissipates in response to said intrusion attempt thereby allowing said elastic force to create said microbend in said fiber optic cable; and determination means for determining the location of said intrusion attempt.

2. The apparatus of claim 1, wherein said at least one access means includes a magnetic portion, and wherein said interactive force includes a magnetic force between said at least one access means and a magnetic component disposed within said housing.

3. The apparatus of claim 2, wherein said elastic force further includes at least one spring disposed within said housing for forcing and holding said bending means to an attenuated position so long as said access means is in an open position, thereby causing said microbend to said fiber optic cable.

4. The apparatus of claim 3, wherein said bending means includes a plunger responsive to said elastic force means that forces said fiberoptic cable into an attenuation well disposed within said housing.

5. The apparatus of claim 1, wherein said interactive force includes at least one rigid linkage fixedly attached with an elastic force compression means, and wherein said at least one access means depresses said at least one rigid linkage when in a closed position causing said elastic force compression means to overcome said elastic force.

6. The apparatus of claim 5, wherein said elastic force further includes at least one spring disposed within said housing for forcing and holding said bending means to an attenuated position so long as said access means is in an open position, thereby causing said microbend to said fiber optic cable.

7. The apparatus of claim 6, wherein said bending means further includes a fiber optic cable securing means for securing said fiber optic cable, wherein said fiber optic cable securing means is fixedly attached to said at least one rigid linkage.

8. The apparatus of claim 6, wherein said bending means further includes a fiber optic cable securing means for securing said fiber optic cable, wherein said cable securing means is fixedly attached to said compression device.

9. The apparatus of claim 1, wherein said determination means further includes an OTDR.

10. The apparatus of claim 1, wherein said determination means further includes at least one light source for transmitting light through the fiber optic cable, at least one photodetector for receiving and measuring the light intensity at the receiver said transmitted light, and wherein said OTDR is responsive to a detection of a loss of light intensity at the receiver.

11. An apparatus that determines the location of an impermissible tamper to an object, wherein said tamper includes the unwarranted movement of said object, said apparatus comprising:

a housing adjacently disposed to said object;

at least one fiber optic cable disposed through said housing;

an elastic force disposed within said housing which cooperates with a bending means for creating a microbend to said fiber optic cable;

an elastic force which cooperates with a bending means for creating a microbend to said fiber optic cable;

an interactive force which overcomes said elastic force in a non-tamper state, said interactive force cooperating with said bending means for keeping said fiber optic cable in an unbended state, wherein said interactive force dissipates in response to said intrusion attempt thereby allowing said elastic force to create said microbend in said fiber optic cable; and determination means for determining the location of said intrusion attempt.

12. The apparatus of claim 11, wherein said object includes a magnetic portion, and wherein said interactive force includes a magnetic force between said object and a magnetic component disposed within said housing.

13. The apparatus of claim 12, wherein said elastic force further includes at least one spring disposed within said housing for forcing and holding said bending means to an attenuated position, thereby causing said microbend to said fiber optic cable.

14. The apparatus of claim 13, wherein said bending means includes a plunger responsive to said elastic force means that forces said fiberoptic cable into an attenuation well disposed within said housing.

15. The apparatus of claim 11, wherein said interactive force includes at least one rigid linkage fixedly attached with an elastic force compression means, and wherein said object depresses said at least one rigid linkage when said object is in a non-tamper state, thereby causing said elastic force compression means to overcome said elastic force.

16. The apparatus of claim 15, wherein said elastic force further includes at least one spring disposed within said housing for forcing and holding said bending means to an attenuated position when said object is in a tamper state, thereby causing said microbend to said fiber optic cable.

17. The apparatus of claim 16, wherein said bending means further includes a fiber optic cable securing means for securing said fiber optic cable, wherein said fiber optic cable securing means is fixedly attached to said at least one rigid linkage.

18. The apparatus of claim 16, wherein said bending means further includes a fiber optic cable securing means for securing said fiber optic cable, wherein said cable securing means is fixedly attached to said compression device.

19. The apparatus of claim 12, wherein said determination means further includes an OTDR.

20. The apparatus of claim 11, wherein said determination means further includes at least one light source for transmitting light through the fiber optic cable, at least one photodetector for receiving and measuring the light intensity at the receiver said transmitted light, and wherein said OTDR is responsive to a detection of a loss of light intensity at the receiver.

21. The apparatus of claim 11 wherein said determination means further includes at least one light source for transmitting light through the fiber optic cable, at least one photodetector for receiving and measuring the light intensity at the receiver said transmitted light, and at least one relay responsive to said measured light intensity for transmitting a signal indicative of a tamper to said object.

22. A method for determining the location of an impermissible tamper to an object, wherein said impermissible tamper includes the unwarranted movement of said object, said method comprising:

running a fiber optic cable through a housing, wherein said housing is installed adjacent to said object;

fiber optic cable positioning means disposed within said housing for positioning a route that said fiber optic cable runs through said housing;

elastic forcing means disposed within said housing for displacing said positioning means thereby forcing a microbend to said fiber optic cable, said elastic forcing means responsive to said impermissible tamper;

second forcing means interactive between said object and at least one internal component of said housing, wherein said second forcing means overcomes said elastic forcing means when said object is in a non-tamper state, and wherein said second forcing means dissipates when said object is in a tamper state, thereby allowing said elastic forcing means to cause said microbend to said fiber optic cable; and location determination means responsive to said elastic forcing means for determining the location of the impermissible tamper to said object.

23. The method of claim 22, wherein said location determination means further includes the steps of transmitting a light signal through said fiber optic cable and determining the intensity of the backscattered light responsive to said transmitted light signal.

* * * * *